United States Patent [19]

Ericsson

[11] Patent Number: 4,730,431

[45] Date of Patent: Mar. 15, 1988

[54] BEAM

[76] Inventor: Roger Ericsson, Fågelvägen 5, S-91300 Holmsund, Sweden

[21] Appl. No.: 767,273

[22] PCT Filed: Nov. 19, 1984

[86] PCT No.: PCT/SE84/00392

§ 371 Date: Aug. 9, 1985

§ 102(e) Date: Aug. 9, 1985

[87] PCT Pub. No.: WO85/02878

PCT Pub. Date: Jul. 4, 1985

[30] Foreign Application Priority Data

Dec. 20, 1983 [SE] Sweden ..... 8307048

[51] Int. Cl.[4] ..... E04C 3/02

[52] U.S. Cl. ..... 52/694; 52/376; 52/692

[58] Field of Search ..... 52/334, 335, 690–695, 52/376, 741

[56] References Cited

U.S. PATENT DOCUMENTS

| | | | |
|---|---|---|---|
| 1,239,043 | 9/1917 | Russell | 52/690 |
| 1,936,147 | 11/1933 | Young | 52/334 |
| 2,558,946 | 7/1951 | Fromson | 52/335 |
| 3,452,502 | 7/1969 | Price | 52/693 |
| 3,813,843 | 6/1974 | Troutner | 52/693 |
| 4,159,606 | 7/1979 | Kindberg | 52/692 |
| 4,372,093 | 2/1983 | Ericsson | 52/694 |
| 4,454,695 | 6/1984 | Person | 52/334 |

FOREIGN PATENT DOCUMENTS

| | | | |
|---|---|---|---|
| 415991 | 6/1923 | Fed. Rep. of Germany . | |
| 812206 | 6/1958 | Fed. Rep. of Germany . | |
| 1215021 | 4/1960 | France | 52/692 |
| 143232 | 9/1977 | Norway . | |
| 8001297 | 6/1980 | World Int. Prop. O. . | |
| 8202916 | 9/1982 | World Int. Prop. O. . | |
| 415991 | 11/1980 | Sweden . | |
| 7610600 | 11/1980 | Sweden . | |
| 751882 | 7/1956 | United Kingdom | 52/690 |

*Primary Examiner*—John E. Murtagh
*Assistant Examiner*—Andrew Joseph Rudy
*Attorney, Agent, or Firm*—Cushman, Darby & Cushman

[57] ABSTRACT

A flanged beam with a web structure formed of a wire or strip-like member (2) bent to zigzag, meander or wave configuration, the bending spots (3) thereof being attached to the flanges (1). The specific feature of a beam performed according to the invention is that at least one flange (1) incorporates a flange section extending alongside this flange. The flange section, which is made of another material than the rest of the flange, is embedded in the flange and is cast to form a unit with it and with the bending spots (3) of the wire or strip-like member (2) which spots are connected with the flange.

9 Claims, 4 Drawing Figures

BEAM

The present invention relates to a flanged beam with a web structure formed of wire or strip-like members bent into zigzag, meander or wave shape and having their bending points secured to the flanges.

BACKGROUND

A beam of this type and a method of manufacturing it is described in e.g. Swedish Lay-Open Print No. 7610600-4. The usage of this as well as other beams is however limited by the bearing capacity and bending properties. These qualities are primarily dependent on the properties of the wooden flanges and on the degree of deformation of the wood at the points where the web of bent metal wire or strip is secured to the flanges. The wood comprised in the flanges must therefore be classified and jointed with great accuracy while complying with the stipulated rules, which is a both complicated and costly procedure. As disclosed in the published "SE-B-" No. 415 991, certain attempts have been made to overcome these drawbacks by attaching wire, extending in the longitudinal direction of the flanges, by welding it to the bending spots of the web. Unfortunately however, this has resulted in productional complications setting aside the economical profit gained by the increased rigidity and bearing capacity of the beam, despite the advantage that a lower quality of wood can be used for the flanged. In fact, welding of the wire extending along the flanges to the bending points of the web must necessarily take place prior to the anti-corrosive treatment of the wire included in the web structure, which treatment cannot be neglected. Beyond being expensive per se as it must be performed individually for each separate unit of the almost lattice-resembling webs created by the wire members welded to the bending points, this anti-rust treatment also eliminates the possibilities of rationally manufacturing finished webs by the continuous bending of an already surface-treated wire taken directly from a supply coil.

SUMMARY OF THE INVENTION

The object of the invention is therefore to suggest a novel and improved type of beam in accordance to what is set forth by way of introduction, which solves the above-described problems associated with the previously known beams and which, despite its more solid and deformation-resistant structure, enables a simplified and less expensive manufacture of beams than has been possible so far.

In order to fulfill its purpose at least in all essential parts, a beam constructed according to the invention is mainly characterized in that at least one flange has a section extending longitudinally with the flange and consisting of another material than the rest of it, and which is embedded in the flange while being cast to form an integral unit therewith and with the bending spots of the wire or strip-like member fixed thereto.

By means of embedding flange sections into the beam flanges, these sections thereby forming a unit not only with the flange but with the web as well, this web structure can be manufactured in a most simple manner from already surfacetreated wire or strip material taken from a storage coil, the invention simultaneously safeguarding a particularly stable deformation-reluctant connection between the bending points of the web and the flanges.

A further, especially important advantage gained by the invention is that the main part of the rigidity and the supporting capacity of the completed beam can, if desired, be transferred to the embedded flange sections, whereas the design of remaining flanges and the material selected therefor can be adapted primarily for nailing and screwing, temperature insulation or any other desirable purpose. As a consequence for example, the quality of the wooden flanges need not be too high, and neither the classification nor the splicing or jointing of the wood need be done with the aid of any sophisticated or costly methods. With the appropriate dimensions and a suitable material selected therefor, the embedded flange sections will constitute the elements taking up most of the load in the beam, relieving in this way the wooden material in the flanges from the greater part of its load-bearing function. In ordinary building beams there are required for this purpose only comparatively small crosssectional areas for the flange sections. Sectional areas as small as one or a few square centimeters will in fact afford considerable reinforcing effects to the beam.

In a preferred embodiment of a beam performed according to the invention, at least the main part of the embedded flange section is disposed in a long channel or groove-like space in the flange, accommodating at least partially the wire or strip-like portions joined to this flange. Without applying the elaborate procedure of wood classification and preparation of wood/metal wire connections associated with the previously known beams, similar beams can be manufactured according to the invention simply by providing a channel or groove along the whole length of the wooden flanges, said groove then serving as a mould when applying the other material intended to form the embedded flange section in accordance with the invention.

In order to ascertain a really efficient cast integration between the embedded flange section and the portions of the web-forming wire or strip-like members disposed inside a flange, the long groove-like space has a bottom which is in communication with additional spaces intended for these web portions.

The section embedded in a flange and consisting of another material than the rest of the flange can either be disposed on the side of the flange facing away from the web, or on the side facing towards it. In the latter case the other flange sections will be more easily accessible for nailing and screwing for example, whereas in the former case the embedded flange section has a more active load-absorbing function due to its placement further away from the so-called neutral surface of the beam.

As embedded flange section of the inventive kind can be made from a variety of compounds of which several plastics with the appropriate amount of fillers seem to be the most useful materials at least for beams in building constructions, and the flanges themselves can be made of wood or the like material fitted for nailing and screwing. Examples of suitable plastics are polyester, acrylate, polyurethane, epoxy resin or similar compounds, which may preferably be reinforced with steel or glass fibre, mica or any other material contributing to the strength of the embedded flange section.

BRIEF DESCRIPTION OF THE DRAWINGS

The invention will be explained in more detail below while referring to an exemplary embodiment of the inventive beam, shown on the drawing.

FIG. 1 in the drawing is a partially cut away perspective view of a beam according to the invention, primarily intended for use in the building industry, whereas

DETAILED DESCRIPTION

Figure 1:
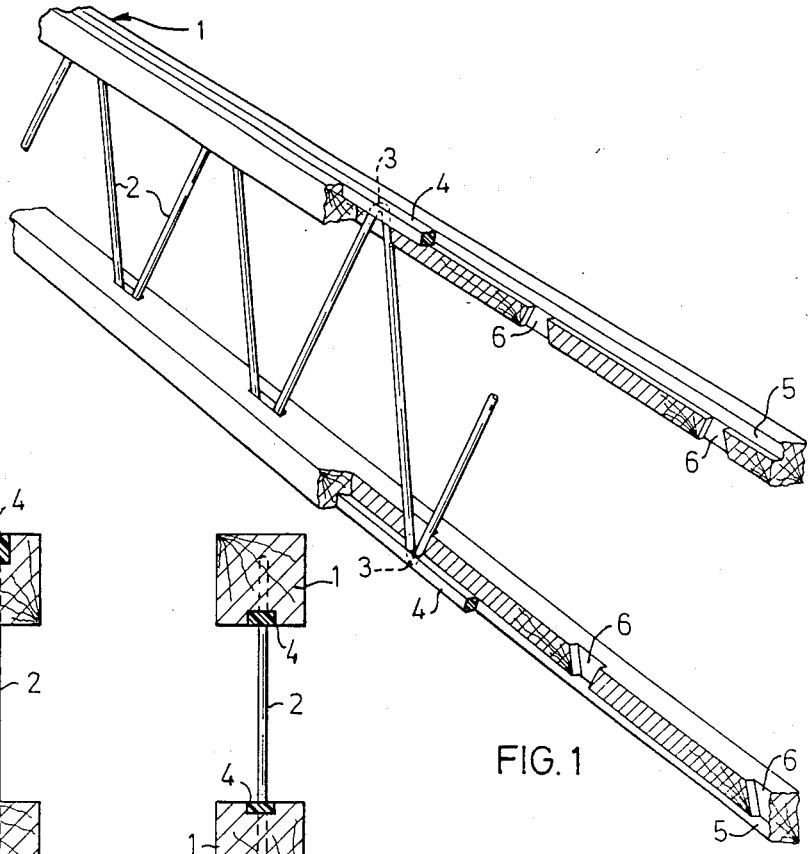

As can be seen from the drawing, a beam according to the invention has two chords or flanges 1 interconnected by a web structure, the beam therefore being regarded as a type of I-beam. The web structure however is formed of a wire or strip-like member 2 bent for example into zigzag, meander or wave shape and having its bending points 3 connected to the flanges 1, the similarity to a conventional I-beam therefore being incomplete.

According to the invention, the two flanges 1 include a long flange section 4 made of another material than the rest of the flange and extending along the length of each respective flange while being embedded therein and cast to form an integral part of the flange and of the bending points 3 of the wire or strip-like member 2, which points are also connected to the flange.

The wire or strip-like member 2 in the embodiment of the inventive beam consists of properly dimensioned steel wire which is bent to the illustrated configuration after having been treated with the necessary anti-corrosive agent. In order to permit screwing and nailing, the main part of the flanges are preferably made of wood, for example studs measuring 2×2". Alternatively, different kinds of wood fibre or chip material can be used for this purpose. In the present embodiment, the flange sections 4 embedded in the flanges 1 may preferably consist of a plastics material mixed with a certain amount of filler and reinforced in order to make the finished, embedded flange section sufficiently strong for taking up at least the main part of the load to which the beam may be subjected during use. Examples of plastics materials useful for the embedded flange section according to the invention are polyester, acrylate, polyurethane, epoxy resin or similar compounds, whereas steel or glass fibre, mica or the like are suitable reinforcement agents.

As shown in the drawing, the embedded flange sections 4 are at least principally disposed in long spaces formed as grooves 5 in the flanges 1, said grooves or spaces 5 partially accommodating those portions of the web-forming, wire or strip-like member 2 which are united with the flanges. For casting together these web portions with the flange sections embedded in the flanges, the long channel-like spaces 5 have a bottom to which are connected further recesses 6 for the portions of the web member 2 disposed inside the remaining flange portion.

Figure 2:
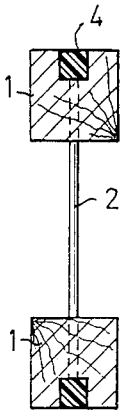
FIGS. 2–4 are three cross-sectional views of such a beam.
Figure 3:
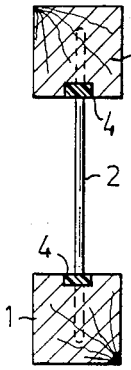
Figure 4:
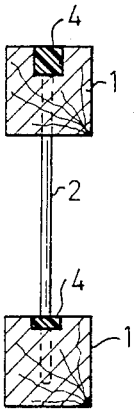

In the embodiment shown here, exemplifying a beam performed according to the invention as illustrated in FIGS. 1 and 2, the embedded flange sections 4 are located at the sides of the flanges 1 facing away from the web 2. As can be seen from the flange cross sections illustrated in FIGS. 3 and 4 however, they can alternatively be placed on the sides of the flange 1 directed towards the web 2, or even such that one embedded flange section 4 is situated on the side of one flange 1 facing away from the web 2, whereas the embedded flange section 4 of the opposite flange 1 is situated on the side thereof turned towards the web 2.

The invention is not restricted to the example described and illustrated herein but can be modified in many ways within the scope of the following claims.

What is claimed is:

1. A longitudinally extending beam having a longitudinal direction and having flanges made from a first material and a web structure formed of a wire or strip-like member bent into zig zag, meander or wave shape, said member having bending points secured to the flanges, characterized in that at least one of the flanges comprises a longitudinally extending flange section made of a material different from the first material of the flange and extending in the longitudinal direction of the flange and being embedded in said rest of the flange and cast to form a unit with said rest of the flange and with the bending points of the wire or strip-like member being joined to the flange section, said flange section material extending a distance in the longitudinal direction coextensive with at least one of said flanges, where at least two bending points are imbedded in said material which is coextensive with said flange.

2. A beam as claimed in claim 1, characterized in that the embedded flange section (4) is at least mainly disposed in a long channel-like space (5) in the flange (1), said space at least partially accommodating portions of the wire or strip-like member (2) connected to said flange.

3. A beam as claimed in claim 2, characterized in that the long channel-like space (5) accommodating the embedded flange section (4) has a bottom which is in communication with additional spaces (6) for portions of the wire or strip-like member (2) disposed inside said flange (1).

4. A beam as claimed in claim 1 characterized in that the embedded flange section (4) is situated on the side of the flange (1) facing away from the web (2).

5. A beam as claimed in claim 1 characterized in that the embedded flange section (4) is situated on the side of the flange (1) facing towards the web (2).

6. A beam as claimed in claim 1 claims, characterized in that the embedded flange section (4) consists of a plastics material supplied with a certain amount of filler such as polyester, acrylate, polyurethane, epoxy resin or the like, reinforced with steel or glass fibre, mica or any other product contributing to the strength of the flange section.

7. A beam as claimed in claim 1 claims, characterized in that the remaining portion of the flange (1) at least essentially consists of wood, wood chip or wood fibre, or any other material suited for nailing or screwing.

8. A beam having a longitudinal dimension comprising: two space-apart, parallel flanges at least one of which includes a longitudinally extending member of wood material having a continuous longitudinal channel in a face thereof and coextensive with the flange, the channel containing a continuous flange section of plastics material cast into the channel and coextensive therewith, the flange section containing reinforcing elements, the beam further comprising a metal web of generally zig-zag configuration located between the flanges, the web having a plurality of longitudinally spaced apart bent portions in contact with and joined to the continuous flange section, said plastics material extending a distance in the longitudinal direction.

9. A beam having a longitudinal dimension comprising: two spaced-apart parallel flanges each constructed of wood material and each flange having a continuous longitudinal channel in a face thereof and coextensive with the flange; a metal web of generally zig-zag configuration located between said flanges, the web having a plurality of longitudinally spaced-apart bent portions disposed in one of the channels and flange sections of plastics material cast into said channels and around said bent portions of said web, said cast flange sections being coextensive with said channels and being joined to said bent portions of said web, and said cast flange sections being the sole longitudinally extending reinforcement for said flanges.

* * * * *